US006520837B2

(12) United States Patent
Weichert

(10) Patent No.: US 6,520,837 B2
(45) Date of Patent: Feb. 18, 2003

(54) METHOD AND APPARATUS FOR ULTRAFINE GRINDING AND/OR MIXING OF SOLID PARTICLES

(76) Inventor: Reiner Weichert, An den Eschenbacher Teichen, 38678 Clausthal-Zellerfeld (DE)

( * ) Notice: Subject to any disclaimer, the term of this patent is extended or adjusted under 35 U.S.C. 154(b) by 71 days.

(21) Appl. No.: 09/761,884

(22) Filed: Jan. 17, 2001

(65) Prior Publication Data

US 2001/0016467 A1 Aug. 23, 2001

Related U.S. Application Data

(63) Continuation of application No. PCT/EP99/05089, filed on Jul. 16, 1999.

(51) Int. Cl.[7] ..... B24B 1/00

(52) U.S. Cl. ..... 451/33; 451/35; 451/53; 451/326; 241/16; 241/17; 241/23; 241/65; 241/184

(58) Field of Search ..... 451/32, 33, 34, 451/35, 53, 326, 327, 328; 241/14, 15, 16, 17, 18, 23, 38, 65, 66, 67, 172, 170, 184, 283, DIG. 38

(56) References Cited

U.S. PATENT DOCUMENTS

| | | | | |
|---|---|---|---|---|
| 3,072,347 A | | 1/1963 | Dombrowski | |
| 3,624,796 A | | 11/1971 | Brociner | |
| 4,013,232 A | | 3/1977 | Broughton | |
| 5,407,464 A | * | 4/1995 | Kaliski | 241/22 |
| 5,513,809 A | | 5/1996 | Perkel | |
| 5,704,555 A | * | 1/1998 | Arastoopour | 241/16 |
| 6,221,151 B1 | * | 4/2001 | Campbell et al. | 106/778 |

FOREIGN PATENT DOCUMENTS

| | | |
|---|---|---|
| DE | 2023995 | 11/1970 |
| DE | 35 05 024 A1 | 2/1985 |
| DE | 37 02 484 A1 | 8/1987 |
| DE | 36 27 283 A1 | 2/1988 |
| DE | 92 08 275 | 10/1992 |
| FR | 2 608 922 A1 | 7/1988 |

* cited by examiner

*Primary Examiner*—Eileen P. Morgan
(74) *Attorney, Agent, or Firm*—Webb Ziesenheim Logsdon Orkin & Hanson P.C.

(57) ABSTRACT

In a method for ultrafine grinding of solid particulate material to mean particle sizes far below 1 micrometer and/or for mixing of powder and agglomerate material with mean particle sizes in the range of nanometers, the material to be ground and/or mixed and an grinding/mixing additive are filled into a cooled grinding chamber containing loose grinding media. By motion of the grinding media relative to adjacent media and to the walls of the grinding chamber the material is ground to the desired particle size and/or is finely mixed. Subsequently the additive is removed from said material. For the production of particle sizes in the range of nanometers and/or for mixing particles of this size range, the method comprises that grinding and/or mixing is carried out in a cooled atmosphere in the presence of a fine grained solidified additive which is chemically inert to said material, preferably water ice or solid carbon dioxide, at temperatures below their melting or sublimation temperature. Subsequently said additive is removed from said material by evaporation. The additive can be evaporated or is volatile at temperatures below 50° C. at ambient pressure. An apparatus for carrying out such method is disclosed.

16 Claims, 2 Drawing Sheets

METHOD AND APPARATUS FOR ULTRAFINE GRINDING AND/OR MIXING OF SOLID PARTICLES

CROSS-REFERENCE TO RELATED APPLICATIONS

This application is a continuation of International Patent Application Number PCT/EP99/05089 filed on Jul. 16, 1999, entitled "Method and Device for Milling and Mixing Solid Materials in an Ultra-Fine Manner" and designating, inter alia, the United States, which claims priority to German Patent Application Serial No. 198 32 304.2, filed Jul. 17, 1998.

BACKGROUND OF THE INVENTION

The invention relates to a method and apparatus for ultrafine grinding of solid particulate material to mean particle sizes far below 1 micrometer resp. to so-called nanosizes and/or for mixing of powder and agglomerate material with mean particle sizes in the range of nanometers (so-called nanopowders) in which the material to be ground and/or mixed (processed) and a grinding/mixing additive are filled into a grinding chamber containing loose grinding media and by motion of the grinding media relative to adjacent media and to the walls of the grinding chamber, the material is ground to the desired particle size and/or is mixed whereupon the additive is separated from the material.

Mills with loose grinding media are employed for ultrafine grinding and mixing of solid materials since long. Such mills are, besides ball mills, vibration mills and agitator mills, also planetary mills. With decreasing size of solid particles, their strength increases. The smaller the particles, the higher the strength of the primary particles or with nanoparticles the strength of ever present agglomerates of particles and the higher the mechanical energy per unit volume required for grinding the primary and agglomerate particles. A lower limit of particle size depending on the material has been observed, below which no brittle fracture occurs. Very fine particles exhibit properties of plastic material. With known methods, nanopowders are only coarsely but not evenly or even completely mixable.

Plastic behavior of the material in combination with high mechanical energy per unit volume transferred to the particles upon the collision of loose grinding media result in compression of fine (ground) particles or fine agglomerates to new strong agglomerates, i.e. re-agglomeration occurs. The high temperatures occurring thereby may even result in sintering with the consequence that agglomerates may exhibit the same strength as the original particles or agglomerates. Therefore a lower limit of achievable particle size exists, which cannot be surpassed with known grinding techniques. This limit depends on the material and is in the range of 1 micrometer.

To reduce plastic behavior, the grinding chamber e. g. of ball mills, vibration mills or agitator mills has been cooled from outside (via a cooling jacket) or from inside (e. g. via the cooled impeller shaft or other inner parts), mostly to temperatures slightly above the freezing point (German utility model 92 08 275), or liquefied gas has been added into the grinding chamber.

For comminution of rubber scrap, liquid nitrogen is sprayed or vaporized in a grinding chamber of a vibration mill (rod mill) which is cooled from outside (U.S. Pat. No. 5,513,809).

For the production of aqueous pigment-dispersions, a filter cake containing 70 to 80% water, for dispersion by comminution, has been frozen partially, i.e. to about 50%, after adding a stabilizer. By agitating with an impeller, e.g. a blade mixer, the agglomerates have been broken up to primary particles of 0.2 to 0.3 micrometer in size and below by means of the formed ice crystals (U.S. Pat. No. 4,013,232).

It has also been tried to comminute particles to sizes of 1 to 20 micrometers (German patent application print 37 02 484) by infiltrating or soaking pre-ground particles of about 50 micrometer size with a swelling fluid, particularly water (supported by ultrasonic waves, if necessary) and then by repeated freezing and thawing. This process is suitable for few materials if at all and is extremely energy consuming.

Prevention of re-agglomeration has been tried by adding additives to the material to be ground and/or mixed. To this end, soft substances, so-called additives, have been added to the material to be processed, e.g. sodium chloride (German laid open patent application print 35 05 024) or graphite, which are softer or more viscoplastic than said material and in which the fragments are held in a dispersed state during grinding. Particles far below 1 micrometer, i.e. nanoparticles, can be produced thereby. The soft additive is removed after grinding—sodium chloride by dissolving in water, graphite by burning off and other additives by dissolving in a solvent.

This method has restrictions and disadvantages. The material completely comminuted or ground and/or mixed, respectively, has to be insoluble in the substance with which the additive is removed after grinding/mixing. In general, contamination by residues of the additive remain, which is not acceptable for many products. If graphite is used as additive and burned off afterwards, then the risk of chemical reactions with the processed material exists.

There is an increasing interest in highly dispersed systems of particles in the range of nanometers. Therefore a grinding and mixing technique becomes necessary which is suitable for grinding and/or mixing of new materials in the field of ceramic materials, materials for the optic and electronic industry, superconducting ceramic materials and compound materials as well as pharmaceuticals.

SUMMARY OF THE INVENTION

It is therefore an object of the invention to provide a method and an apparatus being capable of producing particles in the range of nanometers and/or mix them homogeneously, which are not subjected to the restrictions mentioned above and which provide for new applications for materials which heretofore could not be ground to particle sizes far below 1 micrometer and/or which could not be mixed in the range of nanometer sizes.

In order to meet this object a method for ultrafine grinding of solid particulate material to particle sizes far below 1 micrometer and/or for mixing powder and agglomerate material of nanometer sized particles, respectively, is devised which comprises according to the invention the steps of providing a grinding chamber containing loose grinding media, generating a cooled atmosphere in said grinding chamber, feeding said material to be processed and an additive into said grinding chamber, said additive is solidified and below its melting or sublimation temperature and behaves chemically inert with regard to the material to be processed and which can evaporate and/or is volatile at ambient pressure at temperatures below 50° C., inducing motion of said grinding media relative to adjacent grinding media and to the walls of the grinding chamber until said material is ground to the desired particle size and/or mixed to the desired mixing state, and thereafter removing said additive from the processed material by evaporation.

The invention further provides an apparatus for ultrafine grinding mixing of solid particulate material to particle sizes far below 1 micrometer and/or for mixing of powder and agglomerate material with particle sizes in the range of nanometers, which apparatus comprises a grinding chamber adapted to be charged with loose grinding media and said material to be processed, means for generating a cooled atmosphere in said grinding chamber, means for feeding said material to be processed into said grinding chamber, means for feeding an additive into said grinding chamber, which additive is solidified and below its melting or sublimation temperature and behaves chemically inert with regard to the material to be processed and which can evaporate and/or is volatile at ambient pressure at temperatures below 50° C., said grinding chamber is encased by a cooling jacket with an inlet means and an outlet means for a cooling agent, means for inducing motion of said grinding media relative to adjacent grinding media and to the walls of the grinding chamber until said material is ground to the desired particle size and/or mixed to the desired mixing state, and means for evaporating said additive from said material after grinding and/or mixing.

The feed material and a grinding/mixing additive are fed into a grinding chamber containing loose grinding media and, if applicable, grinding tools (agitator mills) and providing a cooled atmosphere. These material are ground and/or mixed (processed) to the desired particle size and/or mixed by relative motion of the media relative to adjacent media and to the walls of the grinding chamber, and in which thereafter said additive is removed from the processed material. According to the invention the grinding and/or mixing is carried out in a cooled atmosphere in the presence of a solidified additive below its melting or sublimation temperature, which additive behaves chemically inert to the material and which can evaporate and/or is volatile at ambient pressure at temperatures below 50° C. Said additive is subsequently removed by evaporation from the processed material.

Thus, the additive has to be in a liquid or vaporous state at ambient or room temperature and the additive shall be a liquid or vapor or gas and shall be in a solid aggregate state during grinding/mixing. Well suitable additives are water ice or carbon dioxide ice (solid carbon dioxide) or comparable substances like refrigerating agent R134a. Temperatures below about −30° C., especially below −50° C. are for grinding/mixing with water ice, below −80° C. for grinding/mixing with carbon dioxide ice.

For cooling the atmosphere in the grinding chamber down to a low temperatures which prevents melting or evaporation of the additive, appropriately cooled cooling agents are useful but also liquefied gases like liquid nitrogen.

The addition of fine-grained water ice or solid carbon dioxide and the grinding/mixing at low temperatures have the advantages of a careful treatment of the material and that no contaminations are left in the product. A re-agglomeration of ground/mixed very fine particles is suppressed.

Grinding apparatus of known type as said vibration mills and agitator mills can be used after making modifications necessary for coping with and for the cooling to very low temperatures. A vibration mill with water as coolant is known, which can be operated at temperatures not much below 0° C. For that purpose a cooling jacket with in- and outlets for the cooling water is provided encasing the grinding chamber. In the present invention, however, a cooling jacket and a grinding chamber have to be provided, which resist the very low temperatures of a cooling agent even during grinding/mixing operations. The cooling agent is being cooled to the necessary very low temperatures by a refrigerating machine, if not supplied in a liquid state. The cooling capacity has to be so large that the electric power of the mill—which will be nearly completely converted into heat—can be transported away. For agitator or vibration mills usually a jacket encasing the grinding chamber is sufficient since grinding media and material being ground are sufficiently circulated and transported continuously to the walls of the grinding chamber where the heat is removed. Agitator mills require additional cooling of the impeller shaft to guarantee intense heat exchange.

A discontinuously running vibration mill is operated with the following steps:

1. Cooling of the grinding chamber by filling liquid nitrogen into the jacket encasing the grinding chamber;
2. charging of the cooled mill via an opening with grinding media, material to be ground of appropriate particle size, pre-cooled, if necessary, particularly with a mean particle size below about 20 micrometers, or nanopowders to be mixed, respectively, and a cooled solid, fine grained particulate additive;
3. operation of the mill, grinding or mixing, respectively, of the particles;
4. shutting off and heating up of the mill, discharging the ground/mixed material;
5. evaporating or thawing the additive; and
6. in case of water ice as additive—drying the ground/mixed material.

In this case, the mill is operated discontinuously (batchwise). Continuous grinding is also possible, if appropriate flexible and thermally insulated inlet and outlet ducts are used. In addition, feed material has to be cooled and fine-grained additive to be generated and fed continuously to the grinding chamber while operating it. Furthermore, the ground or mixed material has to be discharged continuously, if necessary to be separated from discarded grinding media which have to be recirculated into the grinding chamber in a closed circuit.

Fields of use of the invention are production of nanoparticles of pharmaceutical substances, especially using solid carbon dioxide as an additive, rarely water ice. By grinding at low temperatures even sensitive substances will not be damaged. A standard grinding at low temperatures without the addition of additives would not result in nanoparticles.

The invention can also be used for the production of high-purity nanoparticles for nanostructured materials (ceramics, metals, nano-compound materials, opto-electronic nano-materials). Finally, the invention is suitable for the mixing of nanopowders which were produced by other methods. In general, it is extremely difficult to mix nanoparticles homogenously.

BRIEF DESCRIPTION OF THE DRAWINGS

A preferred embodiment of a grinding apparatus according to the invention is described with reference to a drawing in which shows.

DETAILED DESCRIPTION OF THE INVENTION

Figure 1:
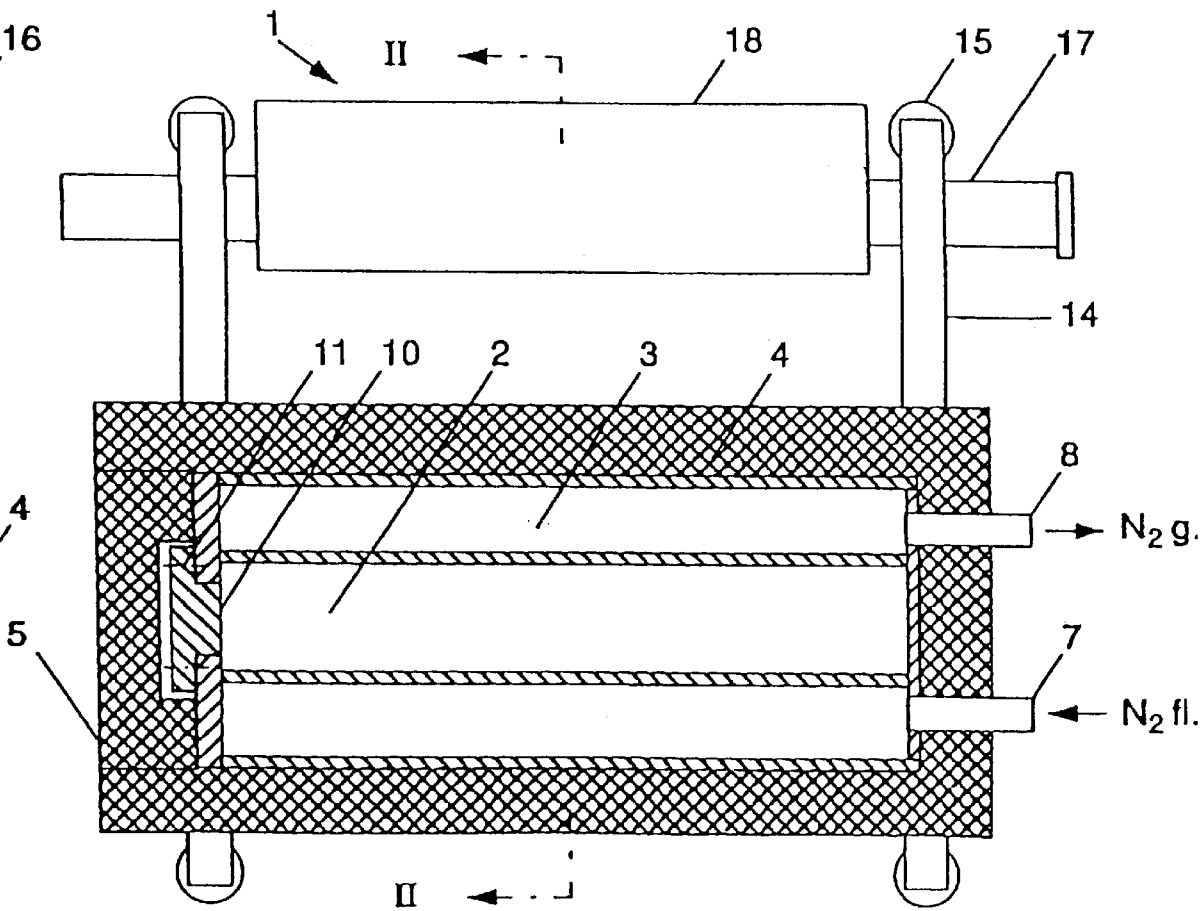
FIG. 1 a plan view of a vibration mill, partly in sectional view.
Figure 2:
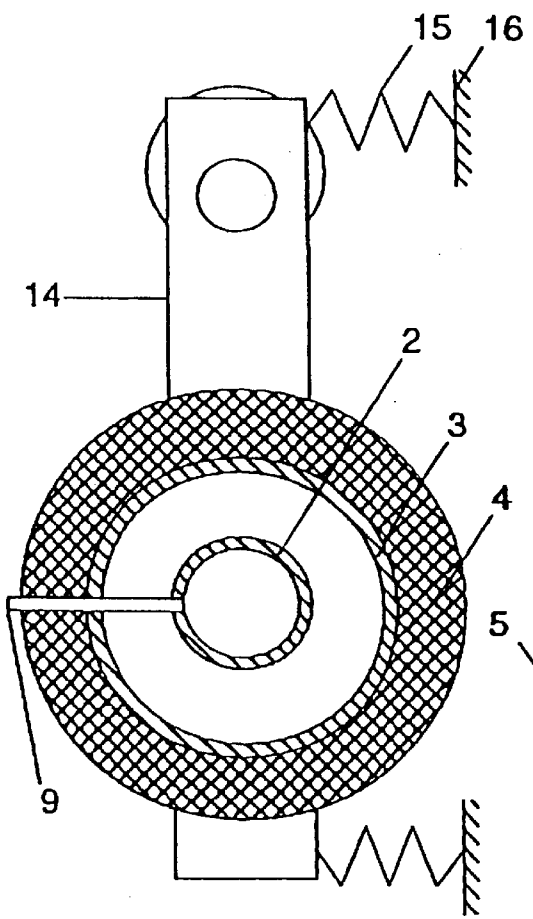
FIG. 2 the vibration mill according to FIG. 1 in a sectional view along line II—II, and FIG. 3 a flow sheet of a milling plant for continuous ultrafine grinding.

A grinding chamber 2 of a generally known vibration mill 1 is completely encased by a cooling jacket 3 and an insulation 4 and is elastically supported on a floor 16. For feeding and withdrawing a cooling agent, like liquid nitrogen, there are provided an inlet 7 and an outlet 8 in the right end wall (FIG. 1) of the cooling jacket 3. On the left side (FIG. 1) of the grinding chamber 2, an opening 10, closed by a cover lid 11, is provided for charging and discharging. On top of this, a plate of insulating material layer 5 is provided, which may be removed to open the lid 11. Through the opening 10, charging of the grinding chamber 2 with grinding media, pre-ground material to be ground and with solidified fine-grained additive, such as water ice or solid carbon dioxide or an appropriate other additive e.g. refrigerating agent R134a, takes place. A vibrating frame construction 14, on which the grinding chamber 2 with cooling jacket 3 and insulation 4 is mounted, is elastically supported by spring elements 15, which are connected to the floor 16. A driving shaft 17 with an excentrically mounted mass 18 is supported by the vibrating frame 14 through a bearing. The shaft 17 is driven by an electric motor and makes the grinding chamber vibrate, which requires flexible ducts for connection to the inlet 7 and the outlet 8.

The grinding chamber is cooled by charging the cooling jacket with the cooling agent before it is charged with grinding media, the material to be ground and with the additive. Then, the drive will be switched on, and the grinding or mixing process, respectively, will start. To obtain fine particles in the range of nanometers, this process can last over a very long time, up to several hours.

Figure 3:
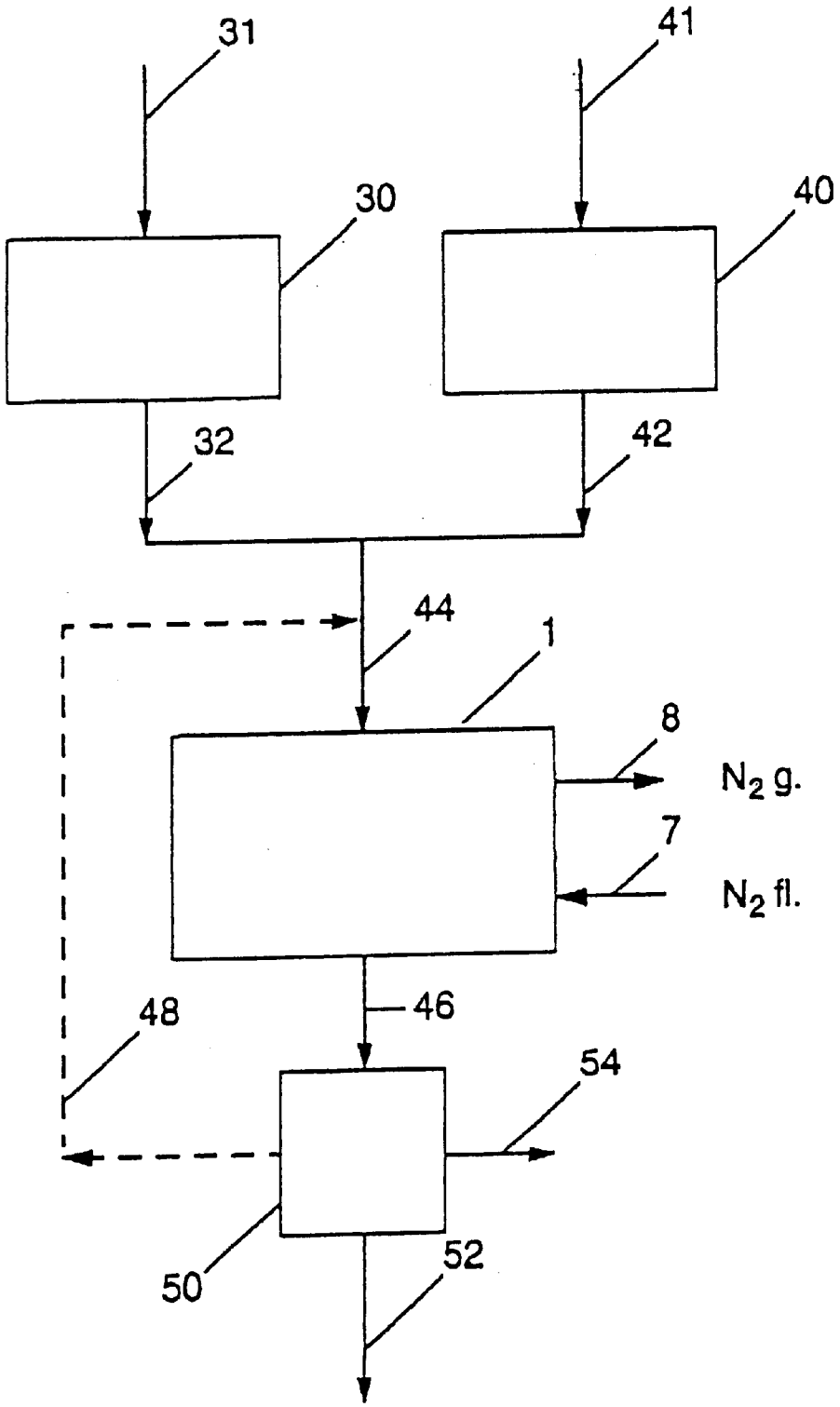

FIG. 3 shows a flow sheet of a continuously operating apparatus with the above-described vibration mill 1 for carrying out the method according to the invention. The vibration mill 1 is charged via a duct 44 from a pre-cooler 30 with the material to be ground or mixed, respectively, which enters the pre-cooler via duct 31 and leaves it via duct 32. The additive is charged to a conditioning device 40 via duct 41 and discharged via duct 42. The conditioning device 40 pre-cools the additive to make it solidify and grinds larger solid particles of the additive in order to obtain a fine-grained particulate additive. The pre-cooled material to be ground or mixed and the conditioned additive are fed together to the vibration mill 1 via charging duct 44. Liquid nitrogen is supplied via flexible inlet 7 into the cooling jacket 3 of the vibration mill 1 and, after heating and evaporation, is removed from there via flexible outlet 8. The ground material is continuously withdrawn via flexible discharging duct 46. The outlet of the grinding chamber might be equipped with a separator wall to hold back the grinding media. The charging duct 44 and the discharging duct 46 have to be flexible, charging duct 44 in addition has to be insulated.

For removal of the additive, the ground and/or mixed material is fed to an additive evaporator 50 for the additive, from where it is withdrawn via duct 52. The material might include grinding media or a fraction of fine grinding media which were not held back. This material may be recirculated through a circulation duct 48 to the charging duct 44. From the additive evaporator 50, the additive is released in gaseous phase via duct 54 and can be recycled and used again. If required, the ground material withdrawn via duct 52 can be fed to a known freeze drying plant, which might be required for the use of water ice as additive.

Although the invention has been described hereinabove as to a preferred embodiment for better understanding, it will be appreciated that a number of variations and modifications may be made without departing from the spirit and scope of the invention.

What is claimed is:

1. A method for ultrafine processing of solid particulate material to particle sizes in the range of nanometers, comprising the steps of:

a. providing a grinding chamber having walls containing loose grinding media;

b. generating a cooled atmosphere in said grinding chamber;

c. feeding said material to be processed and an additive into said grinding chamber, said additive is solidified and below its melting or sublimation temperature and behaves chemically inert with regard to the material to be processed and which can evaporate and/or is volatile at ambient pressure at temperatures below 50° C.;

d. inducing motion of said grinding media relative to adjacent grinding media and to said walls of the grinding chamber until said material is ground to the desired particle size in the range of nanometers; and e. removing thereafter said additive from the processed material by evaporation.

2. The method of claim 1, wherein water ice is used as said additive.

3. The method of claim 1, wherein carbon dioxide ice is used as said additive.

4. The method of claim 2, wherein said processing takes place at temperatures below about −50° C.

5. The method of claim 3, wherein said processing takes place at temperatures below about −80° C.

6. An apparatus for ultrafine processing of material to particle sizes in the range of nanometers, comprising:

a grinding chamber having walls adapted to be charged with loose grinding media and said material to be processed;

means for generating a cooled atmosphere in said grinding chamber;

means for feeding said material to be processed into said grinding chamber;

means for feeding an additive into said grinding chamber, which additive is solidified and below its melting or sublimation temperature and behaves chemically inert with regard to the material to be processed and which can evaporate and/or is volatile at ambient pressure at temperatures below 50° C.;

said grinding chamber is encased by a cooling jacket with an inlet means and an outlet means for a cooling agent;

means for inducing motion of said grinding media relative to adjacent grinding media and to said walls of the grinding chamber, until said material and any agglomerate formed therefrom are ground to the desired particle size in the range of nanometers, whereby said motion of said grinding media also mixes said material homogeneously; and means for evaporating said additive from said material after processing.

7. The apparatus of claim 6, comprising a pre-cooler for said material to be processed.

8. The apparatus of claim 6, comprising a separate conditioning device for non-solidified additive adapted to pre-cool a liquid or a gaseous additive, make it freeze or sublimate and bring the solidified additive into a fine-grained state suited for continuous feeding to the grinding chamber.

9. The apparatus of claim 6, wherein the grinding apparatus is a vibration mill.

10. The apparatus of claim 6, wherein the grinding apparatus is an agitator mill.

11. A method for ultrafine processing of materials to particle sizes in the range of nanometers, comprising the steps of:

a. providing a grinding chamber having walls containing loose grinding media;

b. generating a cooled atmosphere in said grinding chamber;

c. feeding said materials to be processed and an additive into said grinding chamber, said additive is solidified and below its melting or sublimation temperature and behaves chemically inert with regard to the material to be processed and which can evaporate and/or is volatile at ambient pressure at temperatures below 50° C.;

inducing motion of said grinding media relative to adjacent grinding media and to the walls of the grinding chamber until said material is mixed homogeneously, grinding any agglomerate formed in step d to particle sizes in the range of nanometers by further inducing said motion of said grinding media; and f. removing thereafter said additive from the processed material by evaporation.

12. The method of claim 11, wherein said material comprises powder and agglomerate material.

13. The method of claim 11, wherein water ice is used as said additive.

14. The method of claim 11, wherein carbon dioxide ice is used as said additive.

15. The method of claim 13, wherein said processing takes place at temperatures below about −50° C.

16. The method of claim 14, wherein said processing takes place at temperatures below about −80° C.

* * * * *

UNITED STATES PATENT AND TRADEMARK OFFICE

CERTIFICATE OF CORRECTION

PATENT NO. : 6,520,837 B2 
DATED : February 18, 2003
INVENTOR(S) : Reiner Weichert It is certified that error appears in the above-identified patent and that said Letters Patent is hereby corrected as shown below:

Column 8,
Line 1, “inducing motion” should read -- d. inducing motion --.
Line 3, after “homogeneously” delete comma and insert semicolon -- ; --.
Line 4, “grinding” should read -- e. grinding --.

Signed and Sealed this

Eighth Day of July, 2003

JAMES E. ROGAN
*Director of the United States Patent and Trademark Office*